United States Patent [19]

Zimmermann

[11] 3,947,245

[45] Mar. 30, 1976

[54] HOT BLAST STOVE

[75] Inventor: Robert E. Zimmermann, Pittsburgh, Pa.

[73] Assignee: Koppers Company, Inc., Pittsburgh, Pa.

[22] Filed: July 15, 1974

[21] Appl. No.: 488,425

[52] U.S. Cl. ..... 432/217; 432/221

[51] Int. Cl.[2] ..... C21B 9/00

[58] Field of Search ..... 432/214, 216, 217, 218, 432/221; 165/9.3, 9.4

[56] References Cited

UNITED STATES PATENTS

| | | | |
|---|---|---|---|
| 2,175,611 | 10/1939 | Linder | 432/214 |
| 3,033,544 | 5/1962 | Heuer | 432/214 |
| 3,297,310 | 1/1967 | Pentek | 432/214 |
| 3,764,260 | 10/1973 | Smith, Jr. | 432/217 |
| 3,824,070 | 7/1974 | Drebes | 432/217 |

*Primary Examiner*—John J. Camby

*Attorney, Agent, or Firm*—Sherman H. Barber; Olin E. Williams; Oscar B. Brumback

[57] ABSTRACT

In a hot blast stove, a shell structure comprises a checker brick chamber and a common upper portion of the shell embraces a combustion chamber having a length substantially less than the shell structure that is mounted contiguously alongside of and externally to the shell. A refractory lined dome or envelope covers both the checker brick chamber and combustion chamber. Means is provided that supports the combustion chamber and that acts responsively to thermal movement of the combustion chamber; such means existing independently of said shell. In another instance the shell and combustion chamber are self-supporting.

5 Claims, 5 Drawing Figures

HOT BLAST STOVE

BACKGROUND OF THE INVENTION

It is generally agreed that conventional type hot blast stoves having external combustion chambers are costly to build and they require design compromises in order to solve problems of cyclical differential expansions of the lining, shells and hot blast mains.

Conventional hot blast stoves having internal combustion chambers have been developed to the extent that they are satisfactory for use at the temperatures commonly experienced in hot blast stoves. However, such stoves are not satisfactory for use at the very high blast temperatures, which are over 2200°F., toward which blast furnace installations are moving as fast as the use of tuyere injectants and improved burdens permit. Such stoves though are inherently less costly initially for a given active heating surface than external combustion-chamber type stoves.

One factor which exerts the greatest limiting effect on the design of internal combustion chamber hot blast stoves for the desired very high hot blast temperatures, which are above 2200°F., is the sensitive area at the burner level where great temperature differences exist in the refractories over the cross-sectional area. This is true even when ceramic burners are installed that fire in the upward direction along the vertical axis of the combustion chamber to avoid high intensity flame impingement on the vertical combustion chamber wall.

Heretofore, in order to minimize the serious consequences of the temperature differences at the burner cross-sectional level of internal combustion chamber stoves, slip joints, expansion joints, insulation layers, and heat resistant steel barriers have been proposed in the prior art. Also, silica brick has been used because of its refractory and thermal limits, even though it is sensitive to cooling below a temperature of 1100°F.

An object of the present invention is to develop a hot blast stove that does not experience large temperature differences at horizontal cross sections like stoves of the prior art that does not necessitate the use of expansion joints, slip joints and barriers.

BRIEF SUMMARY OF THE INVENTION

A hot blast stove of the invention comprises a shell structure forming a refractory-lined checker chamber; a refractory-lined external combustion chamber of relatively short length located on the shell at the top thereof; and a refractory-lined dome covering both the checker and the combustion chamber. Means acting independently of the shell structure supports the combustion chamber and acts responsively to thermal expansion of the shell structure.

In another embodiment of the invention, the shell and combustion chamber covered by the dome are self-supporting.

For a further understanding of the invention and for features and advantages thereof, reference may be made to the following description and the drawing which illustrates a preferred embodiment of equipment in accordance with the invention.

DETAILED DESCRIPTION

Figure 1:
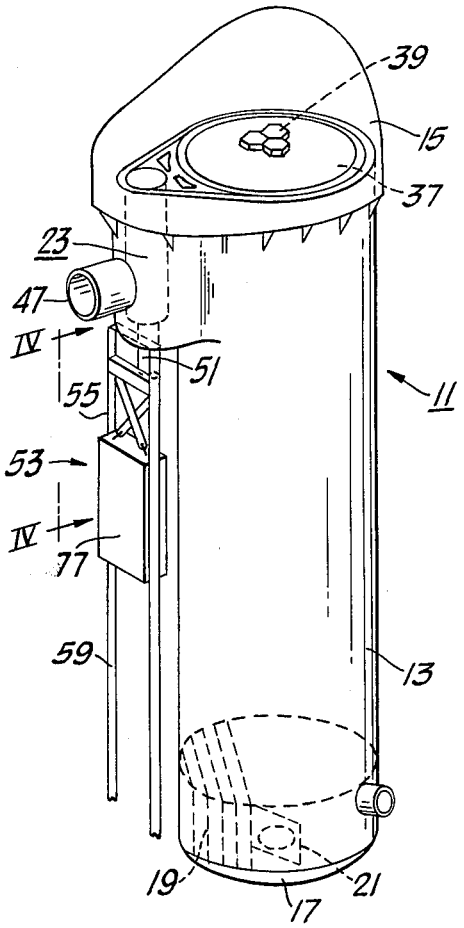
FIG. 1 is a schematic perspective view of a hot blast stove in accordance with one embodiment of the invention.

FIG. 1 illustrates schematically a hot blast stove 11 that includes a cylindrical outer shell 13 and a domed top or envelope 15.

The shell 13 connects to a dished head 17 at the bottom and would, of course be supported on a suitable foundation structure, not shown. Coacting with the dished head bottom 17 and disposed internally of the shell 13 are conventional checker brick supports 19 and a draft baffle 21.

Figure 2:
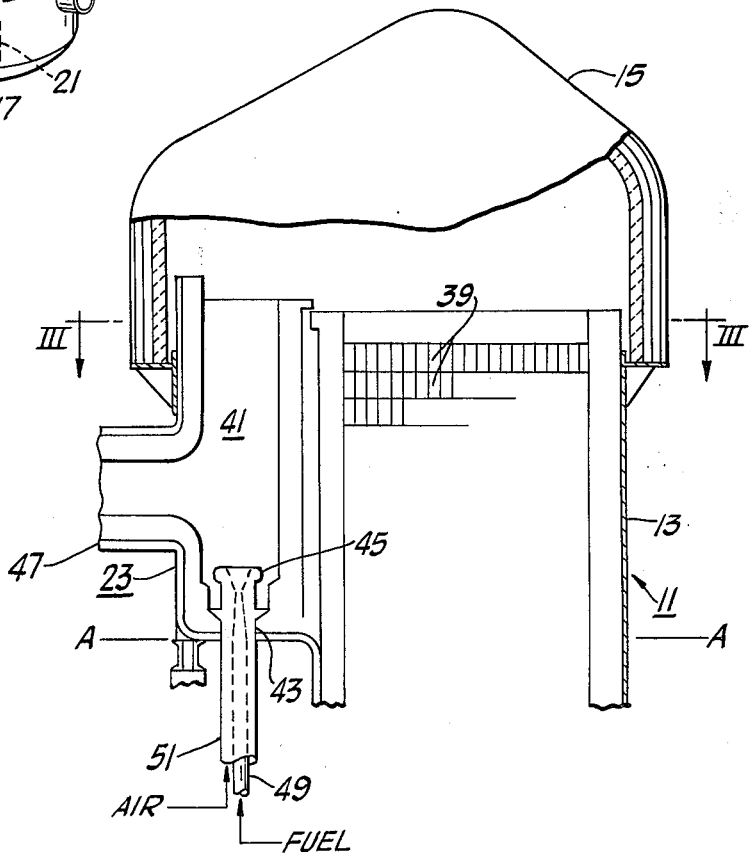
FIG. 2 is a vertical sectional view of the top portion of the apparatus of FIG. 1.

It is to be noted that the shell 13 is entirely cylindrical up to a vertical level at about line A—A shown in FIG. 2. Above this level there is on the shell 13 a refractory-lined external combustion chamber 23 and a common portion of the shell 13 embraces the combustion chamber 23.

Figure 3:
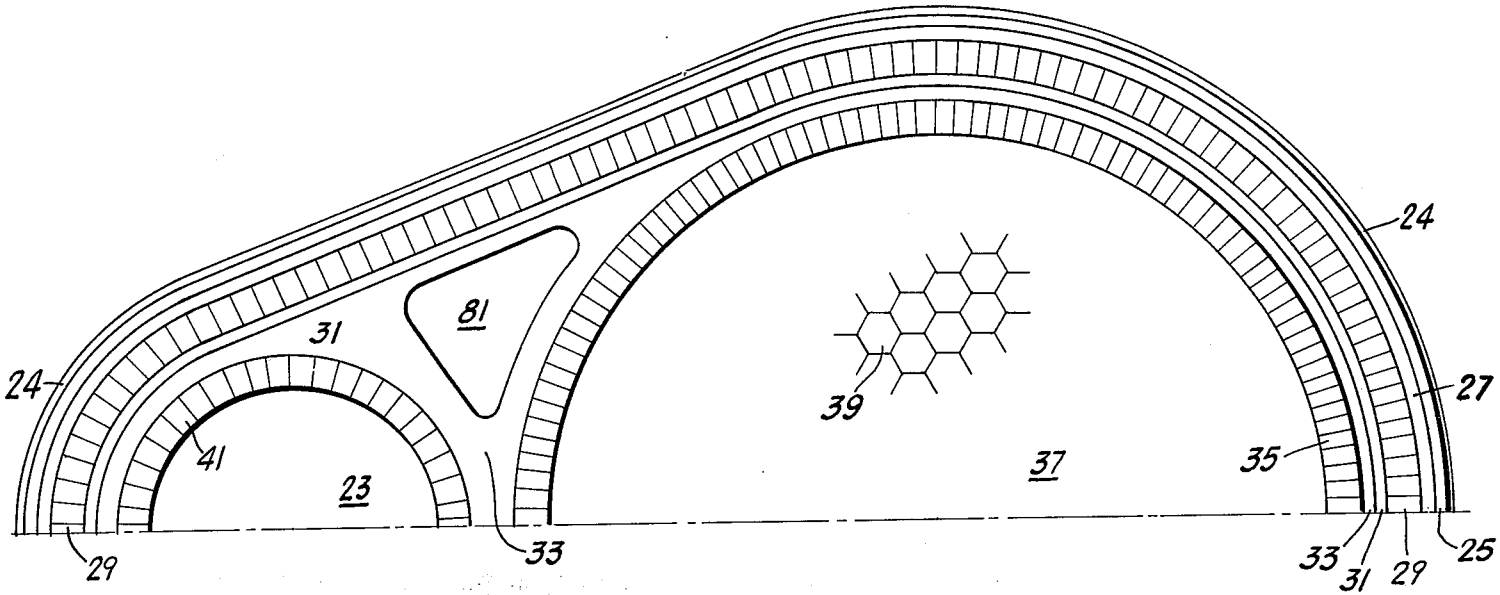
FIG. 3 is a half-sectional view along line III-III of FIG. 2.

FIG. 3 illustrates a one-half section through the domed top or envelope 15 which comprises a shell portion 24 that is lined with layers of various materials. Immediately contiguous with the shell 24 is a layer of flake insulation 25; next adjacent the flake insulation layer 25 is a block insulating layer 27; and next adjacent the block insulating layer 27 is a dome refractory layer 29.

As viewed in FIGS. 2 and 3, there is a layer of flake insulation 31 between the dome refractory layer 29 and a block insulating layer 33 which is the first lining layer of the outer shell 13. Within the insulating layer 33 there is a ceramic ring wall 35 that forms the checker chamber 37 in the stove 11. The checker chamber 37 is, of course, filled in the usual manner with a multitude of layers of refractory checker bricks 39; a few such checker bricks 37 of only the top layer being suggested in FIGS. 1 and 3.

The external combustion chamber 23 is located on the shell 13 at the top thereof, as shown in FIG. 1. It has a refractory lined interior 41 with a nozzle port 43 in the bottom that receives an upwardly directed ceramic burner nozzle 45. A hot blast outlet conduit 47 is located in the side of the combustion chamber 23 about where shown in FIG. 2. The hot blast air emerges from the stove through the outlet conduit 47 and flows thence into a conventional hot blast main (not shown).

The ceramic burner nozzle 45 includes a conduit 49 for fuel gas that is surrounded by a conduit 51, thereby forming an annular passage for carrying air into the burner nozzle.

Figure 4:
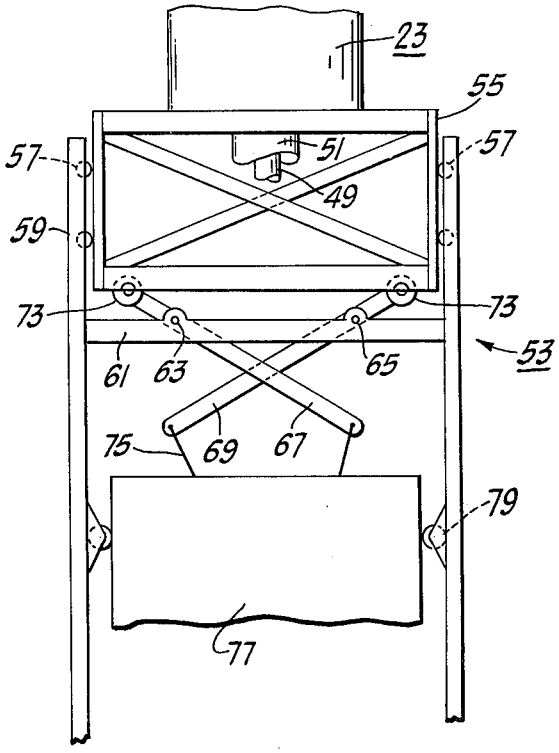
FIG. 4 is a view along line IV-IV of FIG. 1.

The bottom surface of the combustion chamber 23 shown in FIG. 1 rests upon and coacts with structure 53, shown in FIG. 4. The structure of FIG. 4 includes a rectangular truss frame 55 having top and bottom chord members, sides, and diagonal cross braces of suitable structural size and shape. The top chord member of frame 55 coacts with the bottom surface of the combustion chamber 23 in a supporting manner. The side members of the frame 55 engage rollers 57 that are journaled in a pair of vertical columnar support members 59. A cross member 61 is fixed to both vertical columnar support members 59, about as and where shown in FIG. 4.

Pivotally mounted to the cross member 61, as at 63, 65, are arms 67, 69 of a pantograph structure 71. The arms 67, 69 carry at their upper extremities a roller 73 that coacts with the bottom chord member of the frame 55. The lower extremities of the arms 67, 69 are connected by chains 75, or other suitable connecting means, to a counterweight 77. The counterweight 77 coacts with rollers 79 mounted to the vertical columnar members 59, about as shown.

In some instances it may be possible to support the combustion chamber 23 by means of columns and screw jacks or hydraulic cylinders.

Figure 5:
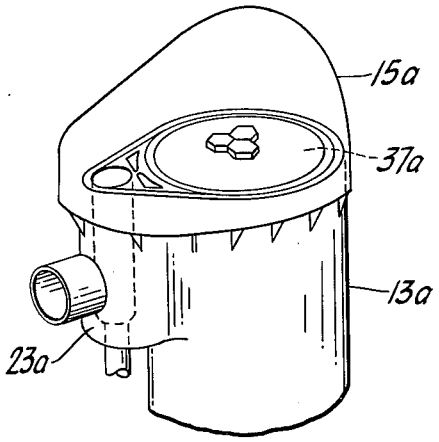
FIG. 5 is a view of a portion of another embodiment of the invention.

In another embodiment of the invention, an external combustion chamber 23*a* and the cylindrical shell 13*a* may be self-supporting without the benefit of other separate supporting means, as shown in FIG. 5. However, the embodiment of the invention in FIG. 5 has a domed top or envelope 15*a* that covers a checker chamber 37*a* and external combustion chamber 23*a*, as the domed top or envelope 15 does in FIG. 1.

Referring to FIG. 3, the cylindrical combustion chamber 23 is spaced apart from the cylindrical checker chamber 37 and the refractory bricks 35, 41 are surrounded by the insulating material 33. It will be noted that two void spaces 81 (since only a half-section of the apparatus is shown in FIG. 3, there is shown only one such void space 81) are provided in the block insulating material 33 between the checker chamber 37 and the combustion chamber 23. It is desirable to fill these void spaces 81 with any suitable insulating material that is available, or with mineral wood insulation.

In order to be able to avoid having to use silica bricks in the combustion chamber, in the dome, in the ring wall, and in the checker brick work of the checker chamber, because the use of silica bricks necessitates the avoidance of cooling them below a temperature of 1100°F., it may be possible to use magnesite brick, or other bricks known as forsterite bricks.

Those skilled in the art will recognize that, since there are no water-cooled burner valves in the burner nozzle 45 that might leak and cause water to impinge on the hot ceramic bricks, and since there is no chemically reactive silica dust in the fuel gas burned in the burner, there is no reason why magnesite or forsterite bricks may not be used in the hotter portions of the stove of the present invention.

The top high temperature heating zone of checker bricks, comprising several courses, which, as mentioned previously herein, can be magnesite bricks; the next lower zone of checker bricks can be composed of mullite; and the bottom zone of checker bricks can be of high duty fireclay. Thus, in a stove of the present invention, it should be unnecessary to use silica brick, special expansion joints and steel barriers, as are required in the stoves as known from the prior art.

Further, in the stove of the present invention, the shape and construction of the dome or envelope affords good uniform distribution of the hot gases from the external combustion chamber over the checker brick chamber area. To assist in such distribution, chimney valve outlets could be arranged in a suitable manner below the checker brick supports since they would not have to be located, as in prior art stoves, only on the side opposite the combustion chamber. Some baffling to equalize draft conditions would be required.

Those skilled in the art will recognize that in the hot blast stove of the present invention an area of active fuel combustion is located at the same horizontal section of the checker chamber wherein the checker bricks are first heated and are always at the highest temperature within the checker chamber.

Further, it should be recognized that in the hot blast stove of the present invention, the refractory walls of the checker chamber and the refractory walls of the dome or envelope overlap, and thermal expansion and contraction of each such wall can occur independently of the other wall.

Although the invention has been described herein with a certain degree of particularity it is understood that the present disclosure has been made only as an example and that the scope of the invention is defined by what is hereinafter claimed.

What is claimed is:

1. A hot blast stove wherein the improvement comprises:

a a vertical shell structure embracing a first chamber containing a plurality of checker bricks;

b a second chamber wherein heat is generated that is located alongside of and contiguous with the top portion of said second chamber and with a common upper portion of said shell embracing said second chamber, said second chamber being shorter than said first chamber; and c a domed top covering said first and second chambers and comprising a conduit for said heat to flow into said first chamber.

2. The invention of claim 1 including:

a means coacting with and applying a force for supporting said combustion chamber as it expands and contracts responsively to thermal movement of said shell.

3. A hot blast stove in which cyclical heating and cooling of checker bricks occurs, wherein the improvement comprises:

a a vertical shell structure comprising an envelope surrounding a first chamber containing checker bricks with the common top portion of said envelope also surrounding a heat generating second chamber that has a materially shorter vertical height than said first chamber;

b means for generating heat in said second chamber; and c top means mounted to said envelope and covering both said first and second chambers and forming a conduit for heat flowing from said second chamber into said first chamber.

4. A hot blast stove wherein the improvement comprises:

a a vertical envelope surrounding checker bricks in a first chamber and also a common portion of said envelope surrounding heat generating means in a second chamber with b said second chamber being materially shorter in vertical height than said first chamber, and with c said common top portion of said vertical envelope being free to expand and contract in response to the amount of heat generated in said second chamber; and d means covering said first and second chambers for conducting heat into said first chamber.

5. The invention of claim 4 including:

a means coacting with and applying a force for continually supporting said second chamber as it expands and contracts responsively to the amount of heat generated therein.

* * * * *